US006758415B2

(12) United States Patent
Fischer et al.

(10) Patent No.: US 6,758,415 B2
(45) Date of Patent: Jul. 6, 2004

(54) FUEL INJECTOR FOR DIESEL ENGINES

(75) Inventors: W. Scott Fischer, Grandville, MI (US); David Eickholt, Kentwood, MI (US); Mike Weston, Lawrence, MI (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/208,587

(22) Filed: Jul. 30, 2002

(65) Prior Publication Data

US 2004/0021008 A1 Feb. 5, 2004

(51) Int. Cl.[7] ..... F02M 59/00; B05B 1/30

(52) U.S. Cl. ..... 239/533.2; 239/533.3; 239/585.1; 239/585.3; 239/585.5

(58) Field of Search ..... 239/533.2, 533.3, 239/533.9, 585.1, 585.2, 585.3, 585.4, 585.5, 600, 88, 89, 90, 91, 93; 251/129.15, 129.21, 127

(56) References Cited

U.S. PATENT DOCUMENTS 4,129,256 A * 12/1978 Bader et al. ..... 239/96
4,568,021 A * 2/1986 Deckard et al. ..... 239/88
6,196,199 B1 * 3/2001 Jiang ..... 123/506
6,227,175 B1 * 5/2001 Jiang et al. ..... 123/496
6,238,190 B1 5/2001 Czarnecki et al.
6,276,610 B1 8/2001 Spoolstra

* cited by examiner

*Primary Examiner*—Davis D Hwu
(74) *Attorney, Agent, or Firm*—Brooks Kushman P.C.

(57) ABSTRACT

A unitary fuel injector and nozzle assembly comprising a high-pressure piston pump and a cylinder body that define a high-pressure fuel pump chamber. An injector nozzle assembly is in fluid communication with the pump chamber and is held in place by a nozzle nut detachably secured to the cylinder body. A nozzle valve assembly includes a spring located in a spring cage within the nozzle nut. A control module is assembled between the cylinder body and the spring cage, the module including a module body having a valve chamber that receives a control valve and a stator assembly as separate and removable elements of the module whereby the stator assembly, the nozzle valve assembly and the control valve can be changed independently of the other elements of the injector to meet various operating requirements.

7 Claims, 5 Drawing Sheets

FUEL INJECTOR FOR DIESEL ENGINES

CROSS-REFERENCE TO RELATED APPLICATIONS

The present application discloses subject matter that is common to U.S. Pat. No. 6,565,020, issued May 20, 2003, entitled "Electromagnetic Actuator and Stator Design in a Fuel Injector Assembly". That patent is assigned to the assignee of the present application.

BACKGROUND OF THE INVENTION

1. Field of the Invention

The invention relates to internal combustion engine fuel injectors having a replaceable control module.

2. Background Art

An example of a fuel injector pump and control valve assembly of known design is shown in U.S. Pat. No. 6,238,190, as well as U.S. Pat. No. 6,276,610. These patents, which are assigned to the assignee of the present invention, disclose a fuel injection pump and valve assembly that comprises a relatively large and complex pump body having a precision-machined pumping chamber and a control valve chamber. The pumping chamber is defined by a pumping cylinder and an engine camshaft-driven piston in the cylinder. A fuel inlet supplies fuel to the pumping chamber. An outlet port communicates with a high-pressure fuel delivery passage extending through the control valve for delivering pulses of pressurized fluid to the nozzle and a nozzle needle valve. The piston, which usually is described as a pump plunger, reciprocates in the pumping cylinder as it is mechanically driven with a pumping stroke frequency directly related to engine speed. A fuel control valve in the control valve chamber establishes and disestablishes fuel delivery from the high-pressure pumping chamber to the nozzle. The control valve is controlled by a solenoid actuator that responds to control current pulses in a driver circuit for an electronic engine control system. The shape of pressurized fuel pulses delivered to the nozzle is under the control of the fuel control valve.

An injector assembly of known design is supplied with fuel from a fuel supply pump, which operates at a relatively low inlet fuel pressure. The fuel circulates continuously through the fuel control valve, the latter being under the control of a control solenoid actuator.

The control valve is movable between open and closed positions. The stroke of the control valve is within a range that includes a rate shape position between the open position and the closed position.

If the operating requirements for the engine with an injector assembly should change, it is necessary to use a different injector assembly. It is not possible to modify independently the operating characteristics by substituting one control valve for another or one stator assembly for another, for example, without replacing the entire assembly.

Furthermore, high volume manufacturing operations for known injector assemblies are characterized by a relatively high scrap rate because it usually is necessary to discard an entire injector assembly if one of its elements or subassemblies is defective or is out-of-tolerance.

The cost of manufacture for known injector assemblies is increased by the precision machining operations that are required during their manufacture. The starting material for forming the injector pump body, for example, is usually a forging that requires a substantial finish machining prior to assembly of the various components of the injector assembly.

SUMMARY OF THE INVENTION

It is an objective of the invention to provide an injector assembly for an internal combustion engine, such as a diesel engine, wherein the essential elements of the injector are formed in separate subassemblies that can be interchanged with other subassemblies without affecting companion subassemblies. This makes it possible to reduce the rate of scrap during high-volume manufacture of injectors. It is an objective also to reduce the cost of manufacture and the cost of materials used during manufacture by reducing the need for finish machining and by reducing the number of assembly steps for the various components. These objectives are achieved in part with the design of the present invention by providing an injector pump body that can be machined using bar stock rather than a forging.

A control module and a stator assembly for the control module are formed as separate elements that can be interchanged with control modules and stator assemblies having different characteristics without affecting the other elements of the assembly. The stator assembly and the control module can be assembled together with a pump body and a nozzle valve and spring subassembly using a simplified assembly technique, which uses a nozzle nut as a clamping element that can be threaded on the cylinder body. The nozzle nut contains a nozzle valve and the control module so that the elements of the injector assembly can be held together in sealing engagement without the requirement for special fasteners or seals.

The injector assembly is characterized by its reduced packaging size as well as its ease of manufacture and reduced manufacturing cost.

The nozzle assembly includes a spring cage for a nozzle valve spring, which engages a nozzle needle valve. A nozzle orifice is opened and closed by the needle valve. The control module has a body with a control valve chamber, which receives a control valve element. An electromagnetic coil actuator in the module body has an armature connected to the control valve element.

A first high-pressure passage is formed in the injector plunger pump body, a second high-pressure passage is formed in the module, and a third high-pressure passage is formed in the spring cage and in the nozzle body, the latter communicating with the discharge orifice as pressure in the third high-pressure passage shifts the needle against the force of the needle valve spring.

The module and the injector pump body have planar surfaces and an interface, whereby the first and second high pressure passages are in communication. The module and the spring cage also have planar surfaces that define another interface, whereby the second and third high-pressure passages are in communication. The module, the nozzle subassembly and the injector pump body are installed in independent, adjacent, stacked relationship as the nozzle nut is connected to the injector plunger pump body.

DETAILED DESCRIPTION OF AN EMBODIMENT OF THE INVENTION

For the purpose of emphasizing the distinctions between known fuel injectors and the injector of the present invention, reference first will be made to the prior art construction of FIGS. 1 and 2.

Figure 1:
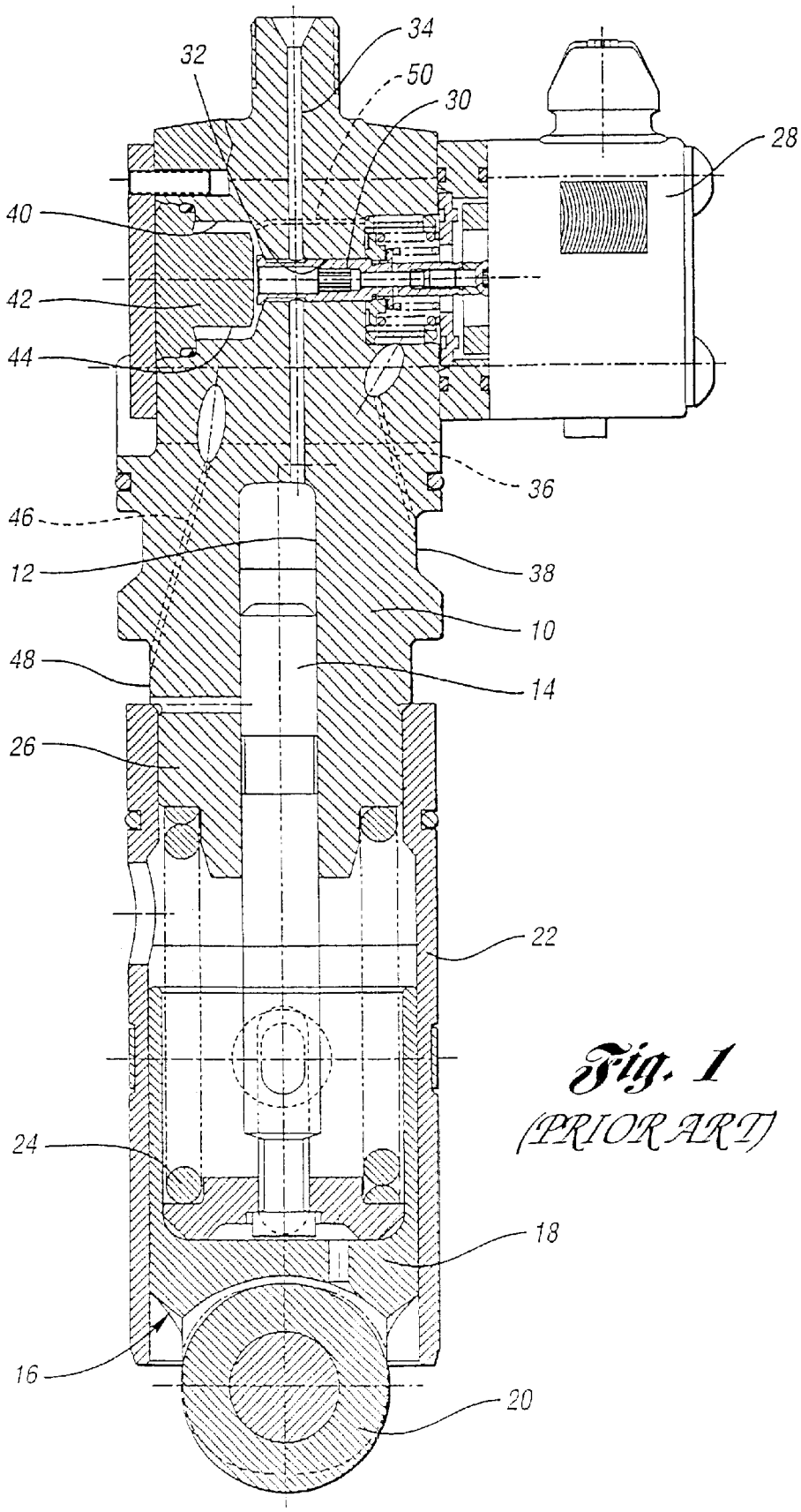
Fig. 1 (PRIOR ART)
FIG. 1 is a cross-sectional view of a fuel injector pump and valve assembly of known design.

The injector of FIG. 1 comprises a an injector pump body 10 having a central cylinder bore 12. Typically, the body 10 would be machined from a forging. A plunger 14 reciprocates in cylinder 12, the plunger being driven by a cam follower assembly 16. The follower assembly 16 includes a cylinder 18 driven by cam roller 20. A camshaft (not shown) drives roller 20 and moves the piston 18 within the cylinder sleeve 22 against the force of spring 24. The sleeve 22 is received over the lower end 26 of the pump body 10. The spring 24 seats on the lower end of the pump body 10, as shown.

The sleeve 22 and the pump body 10 are received in a cylindrical opening in an engine cylinder housing (not shown).

A stator assembly 28 is part of an electromagnetic actuator for a control valve 30, the latter being received in a control valve chamber 32 situated transversely with respect to the centerline of the cylinder 12.

A high-pressure fuel transfer passage 34 is formed in the pump body 10 and extends to an injector nozzle, not shown in FIG. 1.

Fuel is supplied to the right-hand end of the control valve chamber 32 through feed passage 36, which is supplied with fuel from a low-pressure fuel pump. Passage 36 communicates with an annular groove 38, which, together with the cylindrical opening in the engine cylinder housing, define a fuel delivery path from the fuel pump to the right-hand end of the valve chamber 32.

The left-hand end of valve chamber 32 communicates with a chamber 40 in the pump body 10. A valve stop 42 situated in the chamber 40 controls the linear movement of the control valve 30. It cooperates with the opening in the cylinder housing in which it is received to define a fuel chamber 44, which communicates with passage 46 formed in the cylinder body. Passage 46, in turn, communicates with an annular groove 48 formed in the cylinder body. The groove 48, together with the cylindrical opening in the engine cylinder housing, creates an annular fuel flow path that communicates with a fuel return passage for the fuel pump. Chamber 40, which receives the stop 42, and the right-hand end of the valve chamber for valve 30 are in fluid communication with a crossover passage 50. Thus, there is a continuous flow of fuel from the fuel pump through the valve chamber 32 and through the passage 46 to the return side of the low-pressure fuel pump when the valve 30 is in its closed position.

Figure 2:
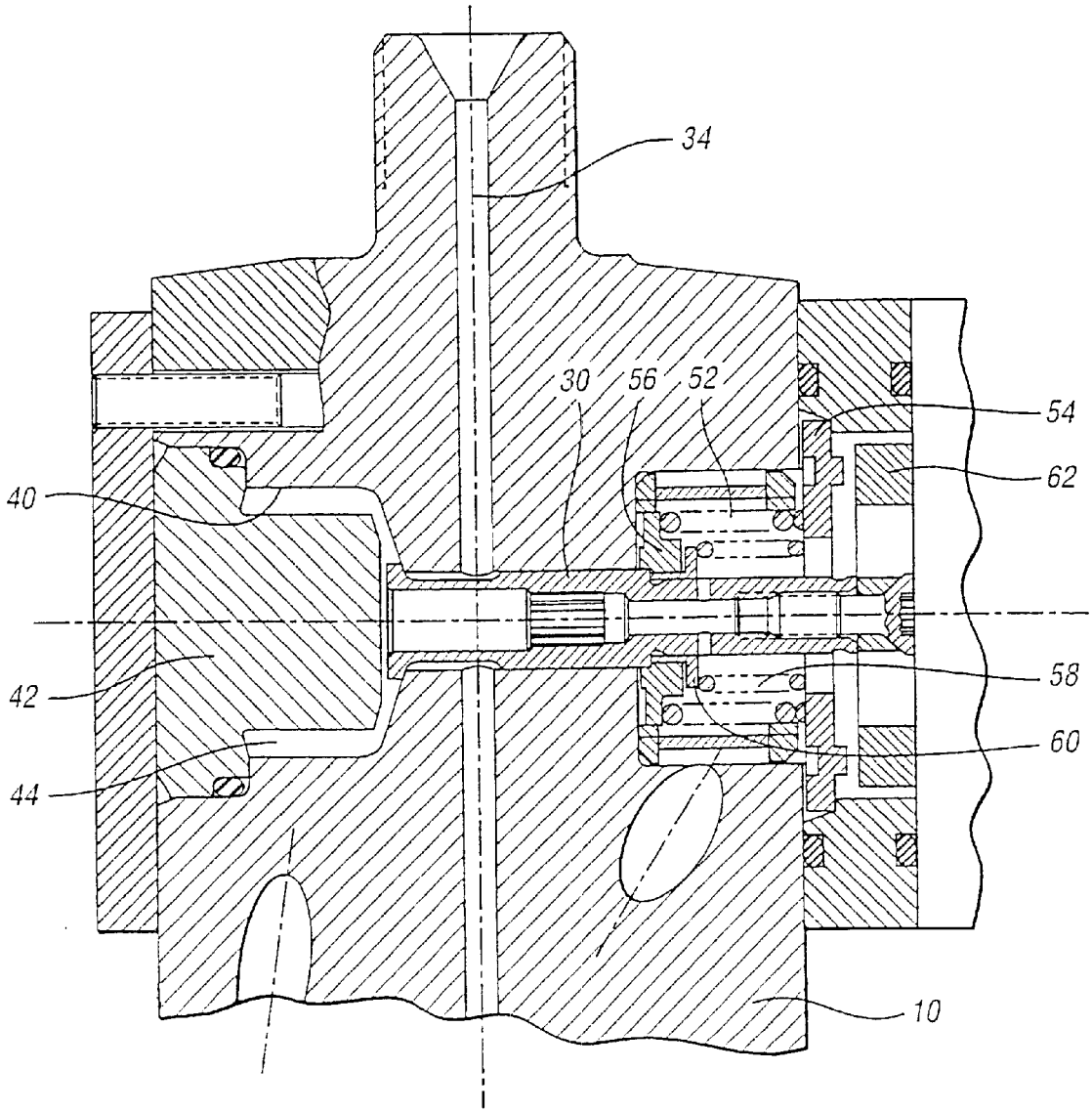
Fig. 2 (PRIOR ART)
FIG. 2 is an enlarged view of the control valve portion of the known injector assembly of FIG. 1.

As seen in FIG. 2, the control valve assembly includes a primary spring 52 seated on a reaction ring 54. A spring seat 56 is engaged by the primary spring 52 so that the valve 30 normally is urged to an open position against the valve stop 42. The secondary spring 58 biases the valve 30 toward the open position throughout the stroke range. Spring 52 biases the valve 30 over a limited portion of the stroke range. The effective travel of each of the active ends of the springs 52 and 58 is determined by the spacing between the spring seats shown at 60 and 56 and between the spring seat 56 and the injector pump body 10.

A solenoid armature 62 is connected mechanically to the right-hand end of the valve 30.

The electromagnetic stator assembly 28 includes stator windings that create a magnetic flux field that attracts the armature 52 when the windings are energized, which shifts the valve 30 to a closed position against the force of the springs 52 and 58. This allows pressurized fluid to be pumped through passage 34 to the nozzle when the plunger 14 is stroked.

In contrast to the conventional design of FIGS. 1 and 2, the design of the present invention includes a relatively small pump body 64. It is provided with a central pumping cylinder 66, which receives plunger 68. A cam follower assembly 70 includes a follower sleeve 72 and a spring seat 74. The sleeve 72 is secured to the outer end of plunger 68. The cylinder 66 and plunger 68 define a high-pressure cavity 78. The plunger is urged normally to an outward position by plunger spring 80, which is seated on the spring seat 74 at the outer end of the plunger. The inner end of the spring is seated on a spring seat shoulder 81 of the pump body 64.

The cam follower 70 is engageable with a surface 71 of an actuator assembly shown at 73, which is driven by engine camshaft 75 in known fashion. Plunger 68 is driven at a stroke frequency directly related to engine speed, as previously explained. The stroking of the piston creates a pumping pressure in chamber 78, which is distributed through an internal passage 82 formed in the lower end of the body 64. This passage communicates with the high-pressure passage 84 formed in the control valve module 86. The opposite end of the passage 84 communicates with high-pressure passage 88 in a spring cage 106 for needle valve spring 92.

When the actuator assembly 73 moves through an angle $\alpha$, there will be a tendency for a transverse load to develop on follower 70. To avoid that transverse load, follower 70 is provided with transverse freedom of movement relative to seat 74 as relative sliding movement at the engaging surfaces of the follower and the seat takes place. Transverse load also may be transmitted from seat 74 to sleeve 72, which is supported by pump body 64. Transverse load thus is not transmitted to plunger 68.

The dimensional tolerances of the plunger 68 and the cylinder 66 provide a fit that is much closer than the fit of sleeve 72 on the body 64. To accommodate the differences in the tolerances for plunger 68 and for the sleeve 72, provision is made for relative sliding movement at the engaging surfaces of the plunger 68 and the seat 74. Thus, there are three locations for compliant shifting movement of the elements of the plunger and actuator mechanism. The first location is the spherical surface at the interface of follower 70 and seat 74. The second location is at the cylindrical surface interface of the sleeve 72 and the portion of body 64 over which the sleeve 72 fits. The third location is at the interface of the plunger 68 and the seat 74.

The spring 92 engages a spring seat 94, which is in contact with the end 96 of a needle valve 98 received in a nozzle element or body 100. The needle valve 98 has a large diameter portion and a smaller diameter portion, which define a differential area 103 in communication with high-pressure fluid in passage 88. The end of the needle valve 98 is tapered, as shown at 102, the tapered end registering with a nozzle orifice 104 through which fuel is injected into the combustion chamber of the engine with which the injector is used.

When the plunger 68 is stroked, pressure is developed in passage 88, which acts on the differential area of the needle valve and retracts the needle valve against the opposing force of needle valve spring 92, thereby allowing high-pressure fluid to be injected through the nozzle orifice. Spring 92, located in a spring cage 106, is situated in direct engagement with the spring seat 108 adjacent the module 86. A spacer 110, located at the lower end of the spring cage 106, positions the spring cage with respect to the nozzle element 100. A locator pin 111 can be used to provide correct angular disposition of the spacer 110 with respect to the spring cage 106.

When the plunger 68 is stroked, pressure is developed in passage 88, which acts on the differential area of the needle valve and retracts the needle valve against the opposing force of needle valve spring 92, thereby allowing high-pressure fluid to be injected through the nozzle orifice. Spring 92, located in a spring cage 106, is situated in direct engagement with the spring seat 108 adjacent the module 86. A spacer 110, located at the lower end of the spring cage 106, positions the spring cage with respect to the nozzle element 100. A locator pin 111 can be used to provide correct angular disposition of the spacer 110 with respect to the spring cage 106.

Figure 3:
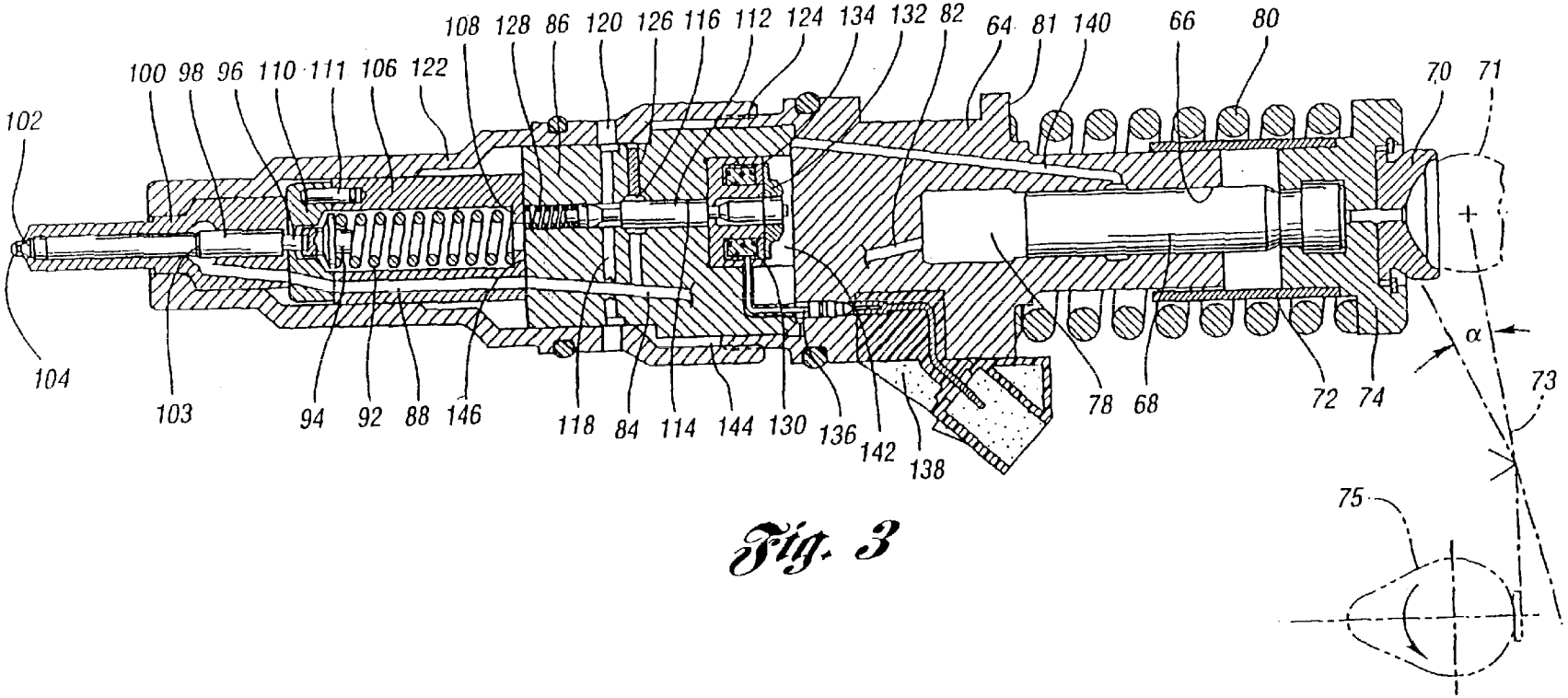
FIG. 3 is a cross-sectional view of one version of the injector of the present invention.

A control valve 112 is located in a cylindrical valve chamber 114. A high-pressure groove 116 surrounding the valve 112 is in communication with high-pressure passage 84. When the valve is positioned as shown in FIG. 3, the valve 112 will block communication between high-pressure passage 84 and low-pressure passage or spill bore 118, which extends to low-pressure port 120 in the nozzle nut 122.

The nozzle nut 122 extends over the module 86. It is threadably connected at 124 to the lower end of the pump body 64.

The connection between passage 84 and groove 116 can be formed by a cross-passage drilled through the module 86. One end of the cross-passage is blocked by a pin or plug 126.

The end of control valve 112 engages a control valve spring 128 located in module 86. This spring tends to open the valve and to establish communication between high-pressure passage 84 and low-pressure passage 118, thereby decreasing the pressure acting on the nozzle valve element.

A stator assembly 130 carries an armature 132, which is drawn toward the stator when the windings of the stator are energized, thereby shifting the valve 112 to a closed position and allowing the plunger 68 to develop a pressure pulse that actuates the nozzle valve element.

The stator is located in a cylindrical opening 134 in the module 86. The valve 112 extends through a central opening in the stator assembly. The windings of the stator assembly extend to an electrical terminal 136, which in turn is connected to an electrical connector 138 secured to the pump body 64. This establishes an electrical connection between an engine controller (not shown) and the stator windings.

A low-pressure passage 140 is formed in the pump body 64. This communicates with a low-pressure cavity 142 at the stator assembly and with a low-pressure region 144, which surrounds the module 86. Fluid that leaks past the plunger 68 during the pumping stroke is drained back through the low-pressure passage 140 to the low-pressure return port 120.

Figure 6:
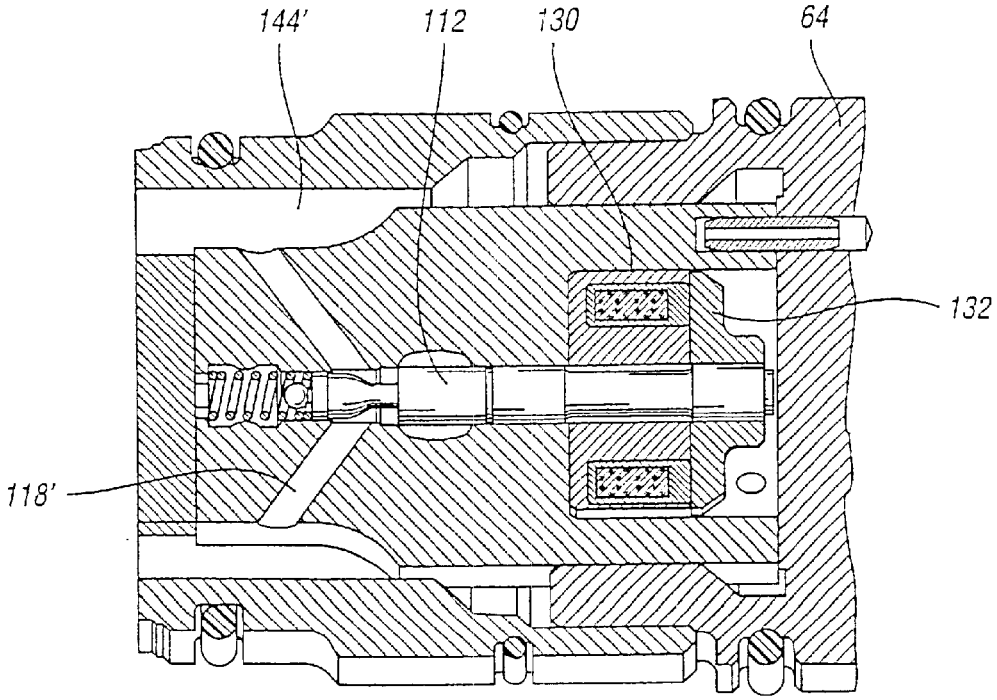
FIG. 6 is another cross-sectional view of the module as shown in FIG. 4 as seen in a cross-sectional plane that is angularly offset from the plane of FIG. 5.
Figure 7:
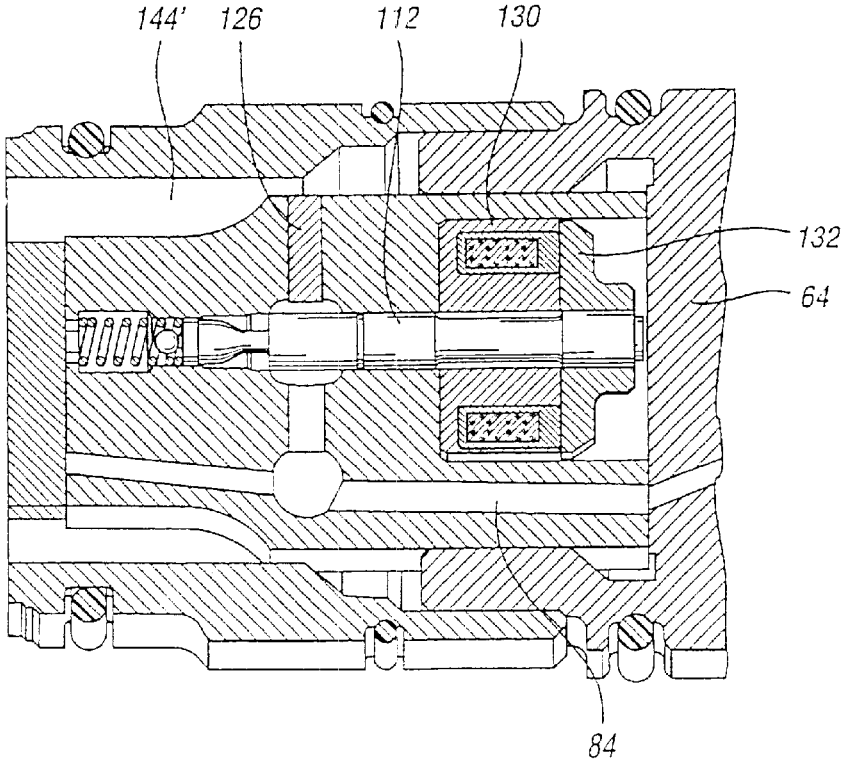
FIG. 7 is another cross-sectional view of the module shown in FIGS. 4, 5 and 6, although the cross-sectional plane of FIG. 7 is angularly offset from the cross-sectional plane of FIG. 6.

The interface of the upper end of the spring cage 106 and the lower end of the module 86 is shown at 146. The mating surfaces at the interface 146 are precisely machined to provide flatness that will establish high-pressure fluid communication between passage 88 and passage 84. The pressure in the module pocket for spring ease 128, however, is at the same pressure that exists in port 120. This is due to the balance pressure port 148, seen in FIG. 4, whereby the pocket for spring 128 communicates with the low-pressure region surrounding the module 86. Spill bores 118' in FIG. 6 correspond to spill bores 118 of FIG. 3.

Figure 4:
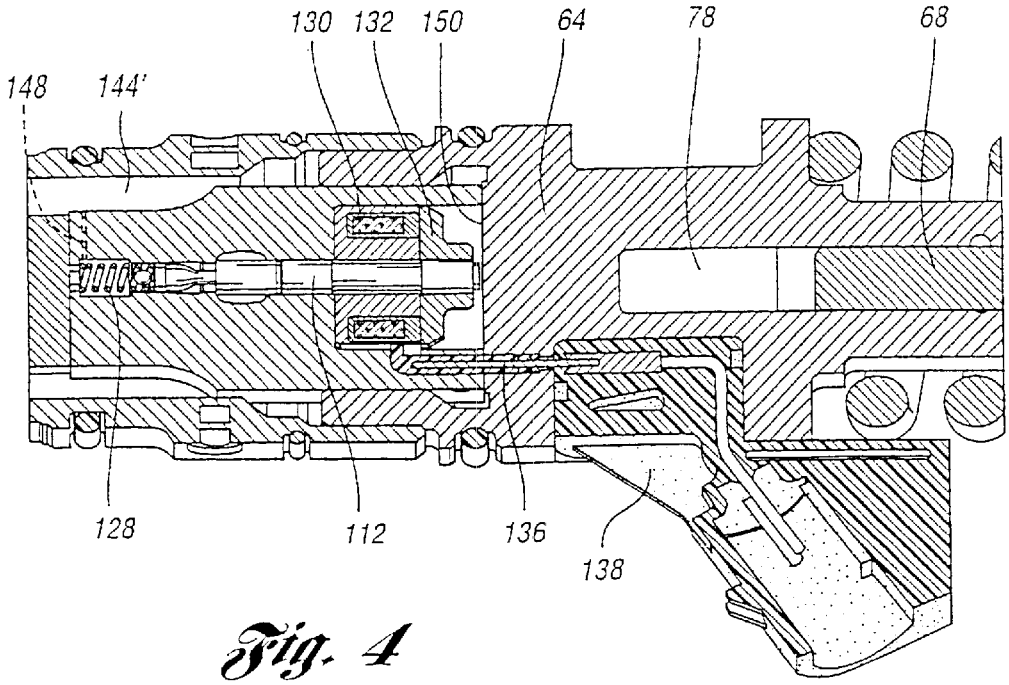
FIG. 4 is a partial cross-sectional view of a second version of the injector of the present invention, as viewed in a cross-sectional plane that is angularly displaced from the cross-sectional plane of FIG. 3.

The interface between the upper end of the module 86 and the lower end of the pump body 64 is shown in FIG. 4. The upper surface of the module 86 and the lower surface of the pump body 64 are precisely machined to establish high-pressure fluid distribution from passage 82 to passage 84. The seal established by the mating precision machined surfaces at each end of the module 86 eliminates the need for providing fluid seals, such as O-rings.

The pump body 64, the module 86, the spring cage 106 and the nozzle element 100 are held in stacked, assembled relationship as the nozzle nut 122 is tightened at the threaded connection 124. The module, the spring cage and the nozzle element can be disassembled readily merely by disengaging the threaded connection at 124, which facilitates servicing and replacement of the elements of the assembly.

Figure 5:
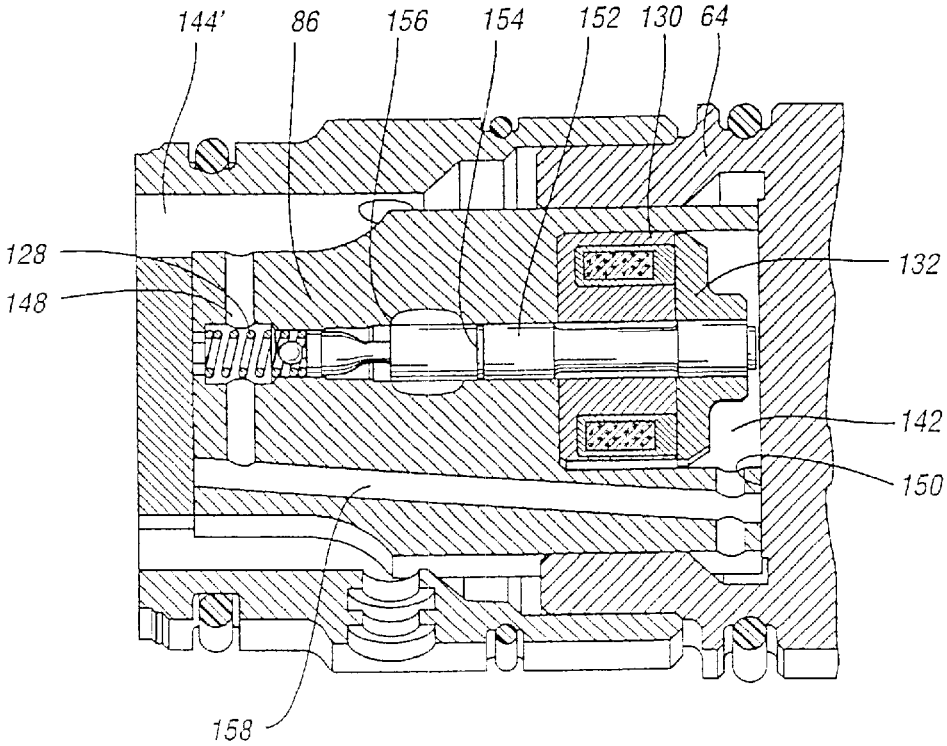
FIG. 5 is an enlarged view of the control valve portion of the assembly of FIG. 4.

As seen in FIG. 5, the valve includes a valve guide portion 152, which is formed with a pressure equalization groove 154 to prevent a pressure differential across the valve that might cause valve friction. The left end of the valve, shown in FIG. 5, registers with a valve seat formed in the valve opening in the module 86.

A balance pressure passage 158 extends in a generally axial direction through the module 86 so that the cavity occupied by the armature, shown at 142, and the module pocket for spring 128 are balanced with the same low pressure that exists in region 144'.

The version of the invention shown in FIG. 3 is identical in function to the version shown in FIGS. 4-7, although the low-pressure regions surrounding the module are shaped differently and the spill bores are at a different angle. The low-pressure regions of each version are identified by the same numerals, although prime notations are used with the numerals seen in FIGS. 6 and 7. Prime notations also are used for numerals identifying the spill bores 118' of FIG. 6 to distinguish from the spill bores 118 of FIG. 3.

Although an embodiment of the invention has been disclosed, it will be apparent to persons skilled in the art that modifications may be made without departing from the scope of the invention. All such modifications and equivalents thereof are intended to be covered by the following claims.

What is claimed is:

1. A fuel injector assembly for an internal combustion engine comprising:

an injector body;

a pump cavity in the injector body;

a plunger in the pump cavity, the plunger defining with the pump cavity a pumping chamber of variable volume as the plunger reciprocates in the pump cavity;

a fuel nozzle subassembly defining a fuel nozzle body with a fuel discharge orifice;

a nozzle needle valve in the nozzle subassembly for alternately opening and closing the discharge orifice as the needle is shifted between a needle valve closing position and a needle valve opening position;

a nozzle nut enclosing the nozzle subassembly, the nozzle nut being releasably connected to the injector body;

a control module subassembly disposed between the injector body and the nozzle subassembly, the control module subassembly comprising a module body with a control valve chamber;

a movable control valve element in the control valve chamber;

an electromagnetic coil actuator in the module body including an armature connected to the control valve element; and a first high-pressure passage in the injector body and a second high-pressure passage in the module body, the injector body and the module body each having a planar surface at an interface between them whereby the first and second high-pressure passages are in communication;

the subassemblies being installed in independent, adjacent, stacked relationship as the nozzle nut is connected to the injector body.

2. The injector assembly set forth in claim 1 wherein the coil actuator includes a first electrical connector element extending through the interface, a second electrical connector element being positioned on the injector body in registry with the first electrical connector element.

3. The injector assembly set forth in claim 1 wherein the plunger includes a cam follower at an operating end thereof and a spring disposed over a portion of the injector body, one end of the spring engaging the cam follower to create a force on the plunger opposing movement of the plunger into the pump cavity.

4. A fuel injector assembly for an internal combustion engine comprising:

an injector body with a pump cavity formed therein;

a plunger in the pump cavity, the plunger defining with the pump cavity a pumping chamber of variable volume as the plunger reciprocates in the pump cavity;

a fuel nozzle subassembly defining a fuel nozzle body with a fuel nozzle discharge orifice;

a nozzle needle valve in the nozzle body for alternately opening and closing the discharge orifice in the needle valve as the needle valve is shifted between a needle valve closing position and a needle valve opening position;

a spring cage adjacent the nozzle body and a spring opening in the spring cage;

a nozzle nut enclosing the fuel nozzle subassembly, the nozzle nut being releasably connected to the injector body;

a valve spring in the spring opening acting on the needle valve to normally close the discharge orifice;

a control module subassembly disposed between the injector body and the nozzle subassembly, the control module subassembly comprising a module body with a control valve chamber;

a movable control valve element in the control valve chamber;

a movable control valve element in the control valve chamber;

an electromagnetic coil actuator in the module body including an armature connected to the control valve element;

a first high-pressure passage in the injector body, a second high-pressure passage in the module body and a third high-pressure passage in the spring cage and in the nozzle body, the latter communicating with the discharge orifice as pressure in the third high-pressure passage shifts the needle valve against the force of the needle valve spring;

the module body and the injector body each having a planar surface at a first interface between them, whereby the first and second high-pressure passages are in communication;

the spring cage and the module body each having a planar surface at a second interface between them whereby the second and third high-pressure passages are in communication;

the subassemblies and the spring cage being installed in independent, adjacent, stacked relationship as the nozzle nut is connected to the injector body.

5. The injector assembly set forth in claim 4 wherein the module body has formed therein a low-pressure passage communicating with the control valve chamber, the low-pressure passage communicating with the spring opening in the spring cage and with the coil actuator at the second interface and at the first interface, respectively, whereby pressure forces on the control valve are balanced.

6. The injector assembly set forth in claim 4 wherein the spring cage and the module are substantially contained in the nozzle nut, the injector body and the nozzle nut being threadably connected together whereby the subassemblies and the spring cage are clamped together in stacked relationship to form a compact injector assembly.

7. The injector assembly set forth in claim 4 wherein the coil actuator includes a first electrical connector element extending through the interface, a second electrical connector element being positioned on the injector body in registry with the first electrical connector element.

* * * * *

UNITED STATES PATENT AND TRADEMARK OFFICE

CERTIFICATE OF CORRECTION

PATENT NO. : 6,758,415 B2
DATED : July 6, 2004
INVENTOR(S) : W. Scott Fischer

It is certified that error appears in the above-identified patent and that said Letters Patent is hereby corrected as shown below:

Column 8,
Line 9, delete lines 9 and 10.

Signed and Sealed this

Twenty-sixth Day of October, 2004

JON W. DUDAS
*Director of the United States Patent and Trademark Office*